United States Patent [19]

Ide

[11] 3,941,258

[45] Mar. 2, 1976

[54] METHOD AND APPARATUS FOR STORING AND UNLOADING BULK MATERIAL

[76] Inventor: Allan R. Ide, 10066 Bloomfield, Cypress, Calif. 90630

[22] Filed: Feb. 4, 1974

[21] Appl. No.: 439,399

[52] U.S. Cl. ..... 214/17 D; 214/152; 222/389

[51] Int. Cl.[2] ..... B65G 65/40

[58] Field of Search ... 214/17 D, 82; 222/95, 386.5, 222/389

[56] References Cited

UNITED STATES PATENTS

| | | | |
|---|---|---|---|
| 3,139,998 | 7/1964 | Seaman | 214/82 |
| 3,351,235 | 11/1967 | Paton | 222/386.5 X |

FOREIGN PATENTS OR APPLICATIONS

| | | | |
|---|---|---|---|
| 1,032,637 | 6/1966 | United Kingdom | 214/17 D |

*Primary Examiner*—Robert G. Sheridan
*Attorney, Agent, or Firm*—Fulwider, Patton, Rieber, Lee & Utecht

[57] ABSTRACT

Bulk storage and unloading apparatus including a storage compartment having a substantially flat bottom and at least one side wall rising upwardly therefrom, a discharge opening being formed in such bottom wall at a location remote from such side wall. A bladder liner extends substantially the whole length of the compartment and lines the bottom wall and projects upwardly along such side wall to at least the angle of repose between such outlet and the side wall for a predetermined bulk material. The bladder is operative upon inflation thereof to first balloon outwardly away from such side wall at the upper extremity thereof to roll the uppermost bulk material away from such side wall and is further operative upon continued inflation thereof to progressively balloon outwardly greater distances from the side wall to progressively roll the uppermost granular material away from such side wall to fall out such outlet.

4 Claims, 4 Drawing Figures

FIG. 1
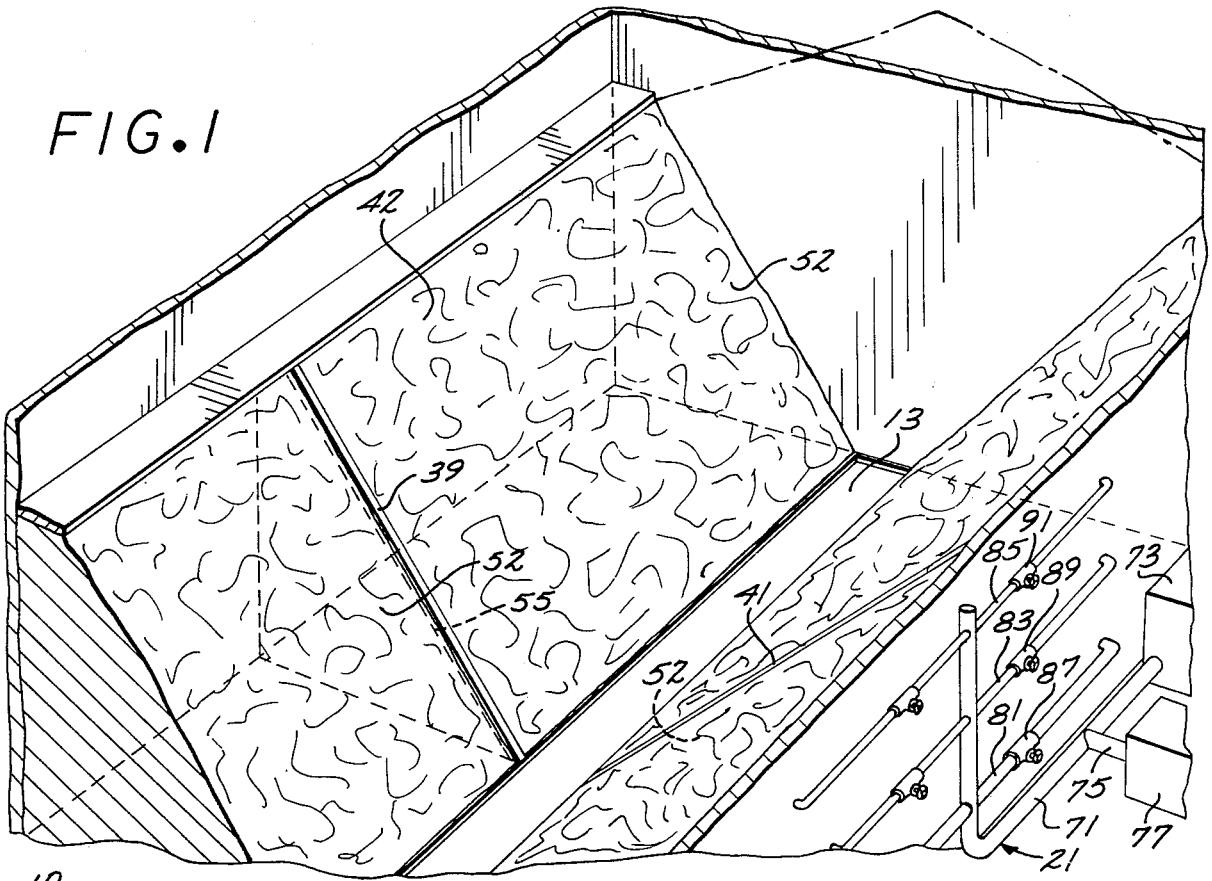
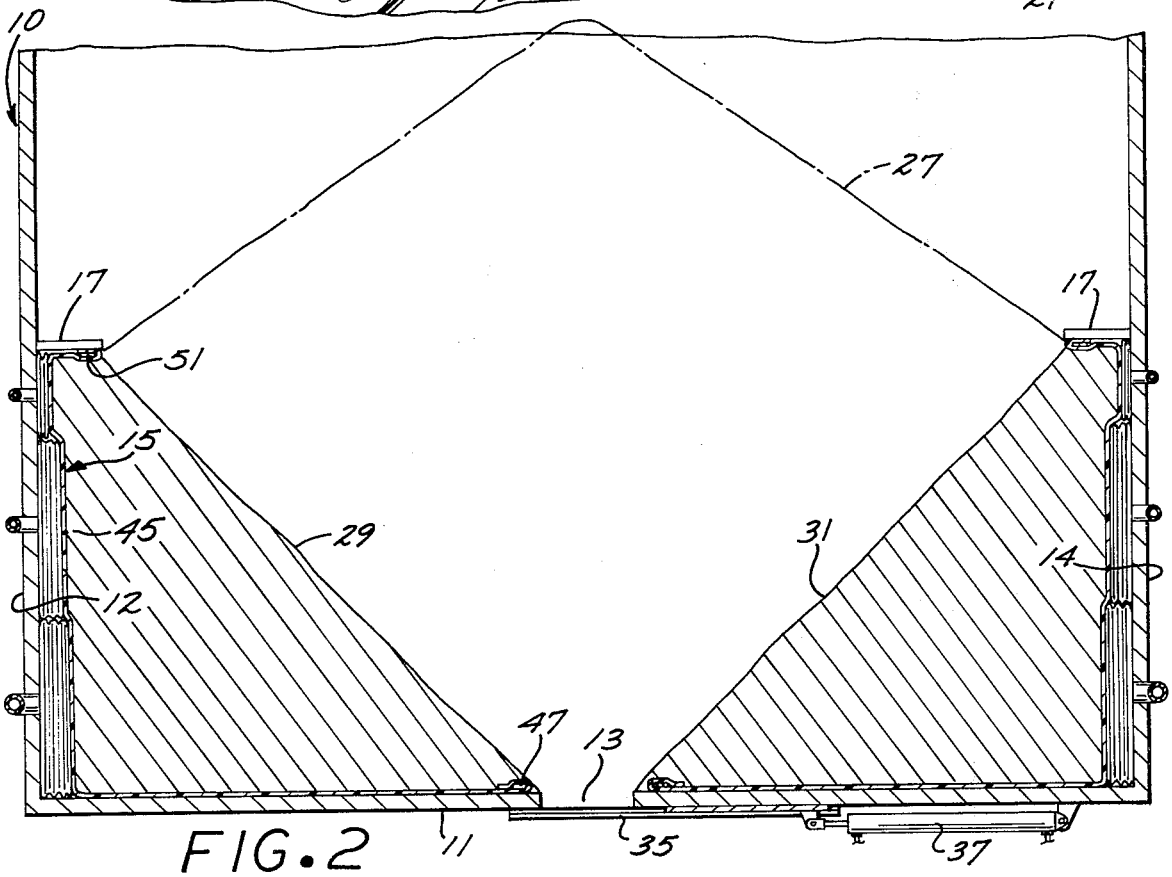
FIG. 2

METHOD AND APPARATUS FOR STORING AND UNLOADING BULK MATERIAL

BACKGROUND OF THE INVENTION

1. Field of the Invention

The bulk storage and unloading apparatus of the present invention relates to a device for rapidly and conveniently unloading bulk material from a storage compartment.

2. Description of the Prior Art

In transporting granular materials such as coke grains and the like it is common practice to store such materials in large warehouses which may be on the order of 400 feet long and store 100,000 tons of coke. It is common practice to provide an outlet in the bottom wall of such warehouses for unloading of the coke or the like into the holds of ships moored adjacent such warehouses. Heretofore, it has been standard practice to provide relatively small discharge outlets in the bottom walls of such warehouses and when such outlets are opened, the granular material will pour therethrough under the influence of gravity at a rate determined by the cross sectional area of such outlets until such time as the angle of repose for the granular material is reached. Thereafter, in order to continue unloading of the warehouse, it is necessary to forcefully shift the remaining granular material toward such outlet for discharge therethrough. Bulldozers have commonly been used in order to make this transfer of material. However, this procedure has proven to be relatively slow and typically only approximately 25,000 tons per hour can be discharged. Further, operation of internal combustion engines within the confines of the warehouse has proven to present health hazards to workmen in such warehouse due to the discharge of fumes and inadequate circulation of air.

Numerous arrangements have been proposed for lining the interior of warehouses with bladders or the like and then inflating such bladders in order to shift the granular material away from the side walls and toward such outlet. However, such arrangements all suffer the shortcoming that they are inflated in such a manner that it is necessary to shift the entire mass of material being shifted, thus necessitating application of extremely high forces which must be withstood by such warehouses thereby necessitating reinforcement of such side walls to such a degree that the overall scheme has been rendered impractical.

SUMMARY OF THE INVENTION

The bulk storage and unloading apparatus of the present invention is characterized by a bladder device which lines the bottom and side walls of a storage compartment and is operative upon inflation thereof to balloon outwardly at approximately the level of the top of the angle of repose at the compartment side walls to roll the uppermost bulk material outwardly away from the side wall to fall downwardly through an outlet in the bottom wall and to continue to progressively balloon outwardly upon continued inflation thereof to continue rolling the uppermost bulk material to progressively roll all such material to such outlet.

The objects and advantages of the present invention will become apparent from a consideration of the following detailed description when taken in conjunction with the accompanying drawings.

DESCRIPTION OF THE DRAWINGS

FIG. 1 is a perspective view, partially broken away, of a bulk storage and unloading apparatus of the present invention;

FIG. 2 is a transverse sectional view, in enlarged scale, of the bulk storage and unloading apparatus shown in FIG. 1.

DESCRIPTION OF THE PREFERRED EMBODIMENT

Figure 3:
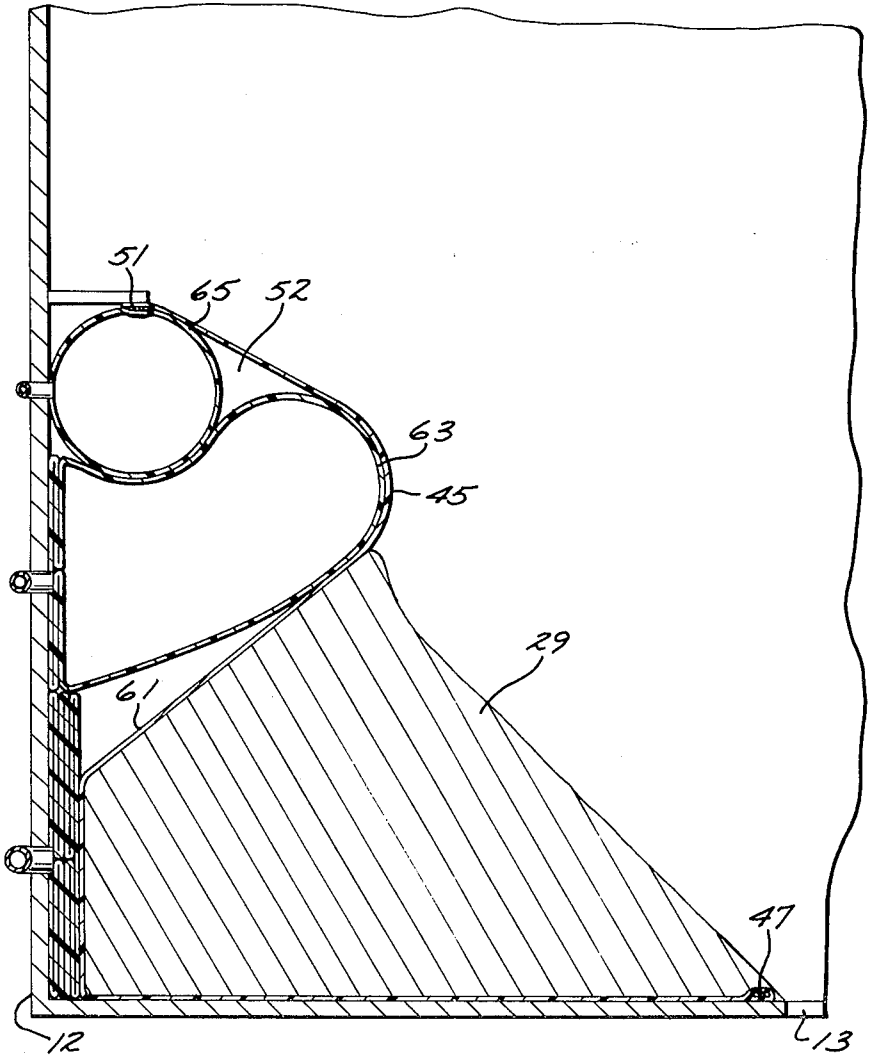

The bulk material storage and unloading apparatus of the present invention includes, generally, a warehouse 10 having a bottom wall 11 which has opposed side walls rising therefrom, such bottom wall being formed with a discharge outlet 13. Bladder devices, generally designated 15, are disposed in the opposite halves of the warehouse 10 and are secured at their lower extremities to the bottom wall adjacent the discharge outlet 13 and project outwardly along such bottom wall to turn upwardly and line the side walls 12 and 14 and to then finally turn inwardly to be secured at their upper extremities to the respective free edges of overhangs 17 which project outwardly into the storage compartment of the warehouse 11. Referring to FIG. 1, a pneumatic system, generally designated 21, is provided for inflating the bladders 15 and such bladders themselves are so devised that upon initial inflation thereof the top portions will balloon outwardly as shown in FIG. 3 to roll the uppermost granular material away from the respective side walls to cause such material to fall downwardly through the discharge outlet 13. Continued pressurization of the bladders 15 will continue to balloon the upper portions thereof outwardly to progressively roll the uppermost granular material away from the side walls and discharge it out the outlet 13.

In the construction of warehouses 10 for the storage of granular material in bulk for shipment by water or rail, it is common practice to provide a discharge outlet 13 in the bottom wall thereof. The granular material, such as coke grain or the like, may then be fed into the warehouse from a conveyor (not shown) to store tens of thousands of tons of such coke in the warehouse for subsequent discharge to bulk transport ships or rail cars. When filled to capacity, the coke or other granular material 23 will rise up the side walls 12 and 14 of the warehouse 10 and then slope upwardly and inwardly to form a triangular mound 27 as shown in broken lines in FIGS. 1 and 2. When the material is to unloaded, it will feed freely out the discharge outlet 13 under the influence of gravity until such time as the banks 29 and 31 shown in solid lines in FIGS. 1 and 2 assume their angle of repose, at which time self-discharge of the material discontinues. It is an object of the present invention to provide an economical, convenient and effective means for effecting discharge of these banks 29 and 31.

It is particularly important that the bladder devices 15 project substantially to the level of the top of the banks 29 and 31 in order to provide for ballooning outwardly of the upper portion thereof upon initial inflation to commence gradual discharge of the material, rather than necessitating application of the high pressures and forces which would be required to shift the entire mass of the banks 29 and 31 horizontally across the bottom wall 11.

Referring to FIG. 1, the discharge outlet 13 is in the form of a narrow slot extending the full length of the bottom wall 11 and is normally closed by means of a sliding door 35 (FIG. 2). The door 35 is opened and closed by means of a hydraulic cylinder 37.

As best seen in FIG. 1, the warehouse 10 is partitioned into a plurality of separate compartments 42 by means of pairs of aligned triangular partition walls 39 and 41 disposed in alignment on opposite sides of the discharge outlet 13.

The overhangs 17 are positioned approximately halfway up the side walls 12 and 14 and project horizontally outwardly into the warehouse storage room a distance sufficient to have their free edges project at least to the angle of repose for the banks 29 and 31. The bladder devices 15 are in the form of liners 45 which, in the preferred embodiment, are affixed at their respective one edges to the bottom wall 11 adjacent the discharge outlet 13 by means of an anchoring flange 37. The liners 45 are in the general configuration of a saddle or peaked roofs having their one legs lining the bottom wall 11 and the other legs thereof lining the respective side walls 12 and 14, the lines then turning inwardly underneath the respective overhangs 17 to be secured to the free edges thereof by means of an anchoring flange 51. The opposite ends of the liners 45 include triangular end walls which normally line the partitions 39 and 41 and are secured at their diagonally extending outer extremities to the free edges of such partitions 39 and 41 by means of anchoring flanges 55.

Figure 4:
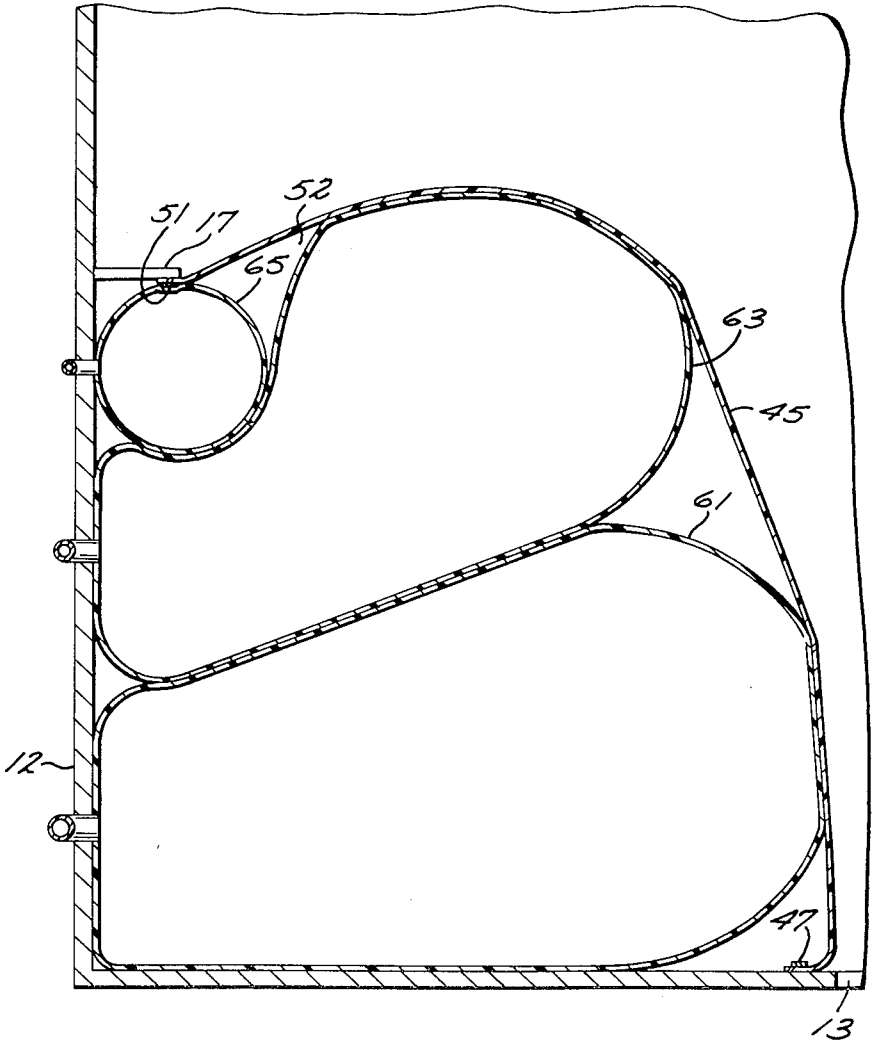
FIGS. 3 and 4 are partial transverse sectional views similar to FIG. 2 but in enlarged scale and depicting progressive inflation of the bladder included in the apparatus shown in FIG. 1.

Referring to FIG. 4, a plurality of elongated bladder tubes 61, 63 and 65 are disposed behind the liners 45 for selective inflation to obtain the desired rolling outwardly from the top of the banks 29 and 31 upon unloading of the warehouse 10. The lower bladder 61 is relatively large in cross section and of sufficient width to project substantially the full distance from the side wall 12 to the discharge outlet 13 upon full inflation thereof, it being appreciated that all such bladders 61, 63 and 65 are of sufficient length to project from one end to the other of the compartments defined between the partitions 29 and 31. The intermediate tube 63 is slightly narrower in width than the lower tube 61 and the top tube 65 is substantially circular in cross section and is relatively small in cross section when compared to the lower and intermediate tubes.

The inflating system 25 includes a main conduit 71 leading from a cinbination air compressor and accumulator tank 73, a vacuum conduit 75 branching off from such conduit 71 and leading to a vacuum pump 77. Branching off from the main conduit 71 are lower, intermediate and upper air pressure conduits 81, 83 and 85 leading to the respective lower, intermediate and upper tubes 61, 63 and 65. The air conduit branches 81, 83 and 85 include respective control valves 87, 89 and 91. These control valves 87, 89 and 91 are shown as being manual valves but in practice, such valves are normally remote controlled solenoid valves.

In operation, when the warehouse 10 is to be supplied with granular material for storage, the control cylinder 37 (FIG. 2) is actuated to close the door 35 and a conveyor (not shown) is actuated to commence dumping the bulk material onto the floor 11 of the warehouse 10. As filling of such warehouse is continued, the bulk material will build up the walls of the warehouse to finally form a mound as depicted by the broken line 27 in FIG. 2.

Thereafter, when it is desirable to discharge the bulk material from the warehouse, as for discharge into the hold of a ship moored beneath or alongside such warehouse, the cylinder 37 (FIG. 2) is actuated to retract the door 35 to discharge the material into a chute or conveyor leading to the hold of such ship. If during the filling of the hold of the ship the bulk material is discharged to the point where gravitational discharge discontinues, the banks 29 and 31 will assume the solid line angle of repose shown in FIG. 2 and further discharge must be forced.

At this point, the air compressor 73 is started to maintain pressurization in an accumulator tank incorporated therewith and the control valve 91 in the conduit 85 leading to the upper tube 65 of the first compartment 42 is opened to initiate inflation of the first bladder tube 65 to be pressurized. As such bladder tube 65 inflates, it will expand outwardly from the compressed position shown in FIG. 2 thereby toppling the uppermost material from the bank 29 or 31 resting thereagainst and causing such uppermost material to tumble down the incline of such bank to discharge through the outlet slot 13. It will be appreciated that since only a small amount of material is being displaced by pressurization of the tube 65, only a relatively small force is required for displament thereof thus applying only a relatively small reaction force to the warehouse side wall 12 and enabling a wall having only conventional reinforcement therein to withstand such forces.

After the uppermost tube 65 has been fully inflated, the control valve 91 controlling pressure thereto will be closed and the control valve 89 controlling pressure to the intermediate tube 63 located immediately below the fully inflated tube 65 will be opened to commence pressurization of such tube 63 to expand it from its collapsed position shown in FIG. 2. It will be appreciated that upon inflation of such tube 63 the projecting portion thereof will seek the path of least resistance, such path being outwardly and upwardly between the liner 45 and the fully inflated bladder tube 65 thus urging such liner even further outwardly away from the side wall 12 to roll greater amounts of the remaining uppermost bulk material from the bank 29 or 31 to dislodge such material for sliding down the incline of such bank to discharge through the slot 13. Continued inflation of the intermediate tube 63 will cause such tube to assume the configuration shown in FIG. 3 and thereafter, the control valve 87 controlling pressure to the lowermost tube 61 may be opened to commence pressurization of such lowermost tube 61. Inflation of the lowermost tube 61 will cause such tube to cooperate with the intermediate tube 63 in continuing to urge the liner 45 outwardly to its fully extended position shown in FIG. 4 thereby rolling all the material in the bank 29 of the compartment 42 being unloaded into the discharge slot 13 for conveyance to the ship hold.

Thereafter, unloading of an adjacent compartment 42 is commenced by sequentially inflating the bladder tubes 65, 63 and 61 of such compartment to fully discharge the bank 29 or 31 of material therein from such compartment. This procedure is repeated for each compartment 42 of the entire warehouse until such warehouse is totally emptied. If desirable, two or more compartments 42 may be unloaded simultaneously to maintain a greater volume of material being conveyed into the ship's hold.

After the warehouse 10 has been emptied, deflation of the tubes 61, 63 and 65 may be commenced by opening the respective control valves 87, 89 and 91 and, if desired, the vacuum pump 77 may be initiated to accelerate deflation of such tubes so they will enable the liner 45 to assume its retracted position shown in FIG. 2. Thereafter, the warehouse 10 is ready for refilling.

While the subject invention has been described as including a plurality of progressively decreasing-in-cross section pneumatic tubes 61, 63 and 65, it will be appreciated that the only requirement of this invention is that the bladder devices 15 be so configured that upon initial inflation thereof ballooning is commenced at the top of the respective banks 29 and 31 and such ballooning continues at the uppermost portion of such banks to cause the uppermost material to continue rolling outwardly away from the respective side walls 12 and 14 and out the outlet 13.

Various modifications and changes may be made with regard to the foregoing detailed description without departing from the spirit of the invention.

I claim:

1. Bulk storage and unloading apparatus for handling a selected granular material having a predetermined angle of repose and including:

storage means including a substantially horizontal bottom wall having upstanding opposite end walls and at least one side wall rising upwardly therefrom to form a storage compartment;

discharge means in said bottom wall and spaced from said side wall a distance sufficient to cause said material, when draining hereinto under the influence of gravity, to form an angle of repose leading upwardly therefrom to a selected level at said side wall;

a bladder device including a liner extending substantially the full length of said compartment affixed at one edge to said side wall at substantially said selected level or thereabove, normally hanging down along said side wall and then projecting outwardly along said end and bottom walls to said discharge means, said bladder device being shaped to assume a loaded configuration lining said bottom end and top walls and to assume an unloaded configuration bulging outwardly from said side wall and turning downwardly to project to said discharge means;

fastening means affixing the marginal edges of said bladder device to said bottom wall adjacent said discharge means;

pressurizing means for pressurizing said bladder device to progressively balloon the upper portion of said bladder device outwardly away from said side wall to roll the uppermost material resting against said bladder outwardly away from said side wall and to then, upon continued inflation, progressively continue bulging said bladder outwardly at its upper portion to continue rolling said material outwardly away from said side wall toward said discharge means to finally bulge the bottom portion of such bladder device away from said side and bottom walls to assume said unloaded position.

2. Bulk storage and unloading apparatus according to claim 1 that includes:

overhang means secured to said side wall adjacent the top of said material at the top of said angle of repose and projecting horizontally outwardly from said side wall and having the top extremity of said bladder device secured to the free extremity thereof.

3. Bulk storage and unloading apparatus for handling a selected granular material as set forth in claim 1 wherein:

said bladder device includes upper and lower bladder tube means disposed between said liner and side wall; and said pressurization means include control means for sequentially inflating said upper tube means and then said lower tube means.

4. A method for unloading granular material from a bulk storage compartment of the type including a substantially horizontal bottom wall having a pair of end walls and a side wall rising upwardly therefrom and formed with a discharge outlet spaced from such side wall a distance sufficient to cause the granular material to drain therefrom under the influence of gravity to form an angle of repose leading upwardly therefrom to a selected level on said side wall, such side, bottom and end walls being lined with a bladder liner which is inflatable to assume an oblate configuration projecting upwardly from such discharge outlet and inwardly from said side wall, the steps of said method including:

drawing said granular material out said discharge outlet sufficiently to cause the upper surface thereof to assume said angle of repose;

inflating the upper portion of said bladder device to bulge the upper portion thereof outwardly away from said side wall to roll the top portion of such granular material away from said side wall to fall down said angle of repose;

further inflating said bladder liner to progressively bulge the upper portion thereof outwardly away from said side wall;

continuing to inflate the upper portion of said bladder liner to progressively bulge the intermediate portion of said bladder liner outwardly from said side wall and to then lift the lower portion of said bladder liner upwardly and outwardly away from the lower portion of said side wall and up off said bottom wall to dump the last of said granular material out said discharge outlet.

* * * * *